US011233345B2

(12) United States Patent
Gross et al.

(10) Patent No.: US 11,233,345 B2
(45) Date of Patent: Jan. 25, 2022

(54) SAFE, ROBUST, COMPACT CONNECTOR

(71) Applicant: FCI USA LLC, Etters, PA (US)

(72) Inventors: Charles M. Gross, Dillsburg, PA (US); James J. Muha, Boiling Springs, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 16/936,847

(22) Filed: Jul. 23, 2020

(65) Prior Publication Data

US 2021/0028563 A1 Jan. 28, 2021

Related U.S. Application Data

(60) Provisional application No. 62/878,711, filed on Jul. 25, 2019.

(51) Int. Cl.
*H01R 12/70* (2011.01)
*H01R 13/422* (2006.01)
(Continued)

(52) U.S. Cl.
CPC ..... *H01R 12/7064* (2013.01); *H01R 12/7023* (2013.01); *H01R 13/28* (2013.01); *H01R 13/4226* (2013.01); *H01R 24/84* (2013.01)

(58) Field of Classification Search
CPC ..... H01R 12/7064; H01R 13/4226; H01R 12/7023; H01R 13/11; H01R 12/722;
(Continued)

(56) References Cited

U.S. PATENT DOCUMENTS 2,994,056 A * 7/1961 Fox ..... H01R 13/514 439/62
3,070,769 A * 12/1962 Murphy ..... H01R 13/28 439/291

(Continued)

FOREIGN PATENT DOCUMENTS

KR 10-2017-0078199 A 7/2017
KR 10-2017-0122112 A 11/2017

OTHER PUBLICATIONS

PCT/US2020/043269, Nov. 5, 2020, International Search Report and Written Opinion.

(Continued)

*Primary Examiner* — Travis S Chambers
(74) *Attorney, Agent, or Firm* — Wolf, Greenfield & Sacks, P.C.

(57) ABSTRACT

An interconnection system that is safe, reliable and compact. Mating connectors include complementary projections. Terminals in each connector have opposed beams, with portions of the beams of each terminal embedded in adjacent projections. In mating connectors, the terminals are oriented 90 degrees with respect to each other, such that the terminals of one connector fit between beams of the other. Two beams of each terminal press on opposing sides of a mating terminal, creating four points of contact, for reliable operation. The projections extend beyond the distal tips of the terminals and preclude accidental contact between the terminals and a human finger. Contact force may be controlled by altering the shape of openings cut in the terminals near the base of the beams, enabling the terminals to be formed simply by stamping a sheet of metal and further enabling the beams to be short to provide a compact connector.

22 Claims, 8 Drawing Sheets

(51) Int. Cl.
*H01R 13/28* (2006.01)
*H01R 24/84* (2011.01)

(58) Field of Classification Search
CPC ..... H01R 13/6273; H01R 13/4361; H01R 24/84; H01R 13/28
USPC ..... 439/284, 290, 291
See application file for complete search history.

(56) References Cited

U.S. PATENT DOCUMENTS 3,086,188 A * 4/1963 Ross ..... H01R 24/84 439/291
3,337,838 A * 8/1967 Damiano ..... H01R 13/432 439/295
3,609,650 A * 9/1971 Stokes ..... H01R 12/7088 439/636
3,686,617 A * 8/1972 Uberbacher ..... H01R 13/28 439/291
4,061,406 A * 12/1977 Kunkle ..... H01R 13/28 439/291
4,082,397 A * 4/1978 Tanaka ..... H01R 13/28 439/291
4,455,056 A * 6/1984 Herrmann, Jr. ..... H01R 13/53 439/284
4,708,660 A 11/1987 Claeys et al.
6,383,032 B1 5/2002 Gerberding
8,251,758 B2 * 8/2012 Yoshida ..... H01R 13/112 439/884
9,209,568 B2 * 12/2015 Yu ..... H01R 13/64
9,853,388 B2 12/2017 Copper et al.
9,972,931 B1 * 5/2018 Chen ..... H01R 13/112
2009/0023325 A1 1/2009 Chen et al.
2010/0120280 A1 5/2010 Shen et al.
2017/0310036 A1 * 10/2017 Ono ..... H01R 13/44
2018/0159270 A1 6/2018 Sato

OTHER PUBLICATIONS

International Search Report and Written Opinion dated Nov. 5, 2020 in connection with International Application No. PCT/US2020/043269.

* cited by examiner

SAFE, ROBUST, COMPACT CONNECTOR

CROSS-REFERENCE TO RELATED APPLICATIONS

This application claims priority to and the benefit under 35 U.S.C. § 119(e) of U.S. Provisional Patent Application Ser. No. 62/878,711, filed on Jul. 25, 2019, entitled "SAFE, ROBUST, COMPACT CONNECTOR," which is hereby incorporated herein by reference in its entirety.

FIELD OF THE INVENTION

This disclosure relates generally to electrical interconnection systems and more specifically to power and/or signal connectors.

BACKGROUND

Electrical connectors are used in many electronic systems. It is generally easier and more cost effective to manufacture a system as separate electronic subassemblies, such as printed circuit boards ("PCBs") or battery packs, which may be joined together with electrical connectors. In some scenarios, the PCBs or other subassemblies to be joined each have connectors mounted to them, which may be mated to directly interconnect the subassemblies.

In other scenarios, the subassemblies are connected through a cable. Connectors may nonetheless be used to make such connections. The cable may be terminated at at least one end with a cable connector. A PCB may be equipped with a board connector into which the cable connector can be inserted, making connections between the PCB and the cable. A similar arrangement may be used at the other end of the cable, connecting the cable to another subassembly, so that signals or power may pass between the subassemblies through the cable.

Electrical connectors may be designed to meet one or more requirements. Their designs may be intended to provide certain electrical properties in the conducting paths through the connector. Examples of electrical properties that may be considered in connector design include crosstalk, impedance, bulk resistance or contact resistance. In other instances, the overall connector characteristics may be considered, such as size, cost, weight or safety. In yet other instances, mechanical characteristics, such as mating force or un-mating force or reliability may be considered in designing a connector. Often, techniques to achieve one requirement interfere with achieving another requirement such that simultaneously achieving multiple design requirements can be challenging.

SUMMARY

In accordance with some embodiments, an electrical connector comprises an insulative housing comprising a mating face comprising a plurality of projections arranged in pairs. The electrical connector also comprises a plurality of terminals comprising mating contact portions, each mating contact portion comprising a first beam and an opposing second beam. Each of the plurality of terminals is held within the insulative housing with the first beam of the terminal at least partially within a first projection of a pair of projections of the plurality of projections and the second beam of the terminal at least partially within a second projection of the pair of projections. The first projection of the pair and the second projection of the pair are separated by a gap sized to receive a mating terminal with a mating contact portion perpendicular to mating contact portions of the plurality of terminals.

In accordance with other embodiments, a first electrical connector is configured to mate with a second electrical connector. The first electrical connector comprises a first insulative housing comprising a first plurality of projections separated so as to provide spaces adjacent the projections of the first plurality of projections. The first electrical connector also comprises a first plurality of terminals comprising a plurality of mating contact portions, each mating contact portion of the plurality of mating contact portions comprising a first beam and an opposing second beam, wherein each of the first plurality of terminals is held within the first insulative housing with the first beam of the terminal at least partially within a first projection of the first plurality of projections and the second beam of the terminal at least partially within a second projection of the first plurality of projections. The second electrical connector comprises a second insulative housing comprising a second plurality of projections sized to fit within the spaces adjacent the projections of the first plurality of projections. The second electrical connector also comprises a second plurality of terminals comprising a plurality of mating contact portions, each mating contact portion of the plurality of mating contact portions comprising a first portion held within a first projection of the second plurality of projections, a second portion held within a second projection of the second plurality of projections. The first electrical connector and the second electrical connector are configured such that, upon mating, the first beam and the second beam of the first plurality of terminals press on respective terminals of the second plurality of terminals between the first portions and the second portions of the respective terminals.

In yet other embodiments, a method of mating a first electrical connector with a second connector comprises inserting first insulative projections of a mating face of the first connector in openings between second insulative projections in a mating face of the second connector and inserting the second insulative projection in openings between the first insulative projections. The method further comprises, in each of a plurality of spaces bounded by adjacent first insulative projections and adjacent second insulative projections, sliding at least two contact surfaces of a first terminal in the first connector across at least two surfaces of a respective second terminal in the second connector and sliding at least two contact surfaces of the second terminal in the second connector across at least two surfaces of the respective first terminal in the first connector.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1A:
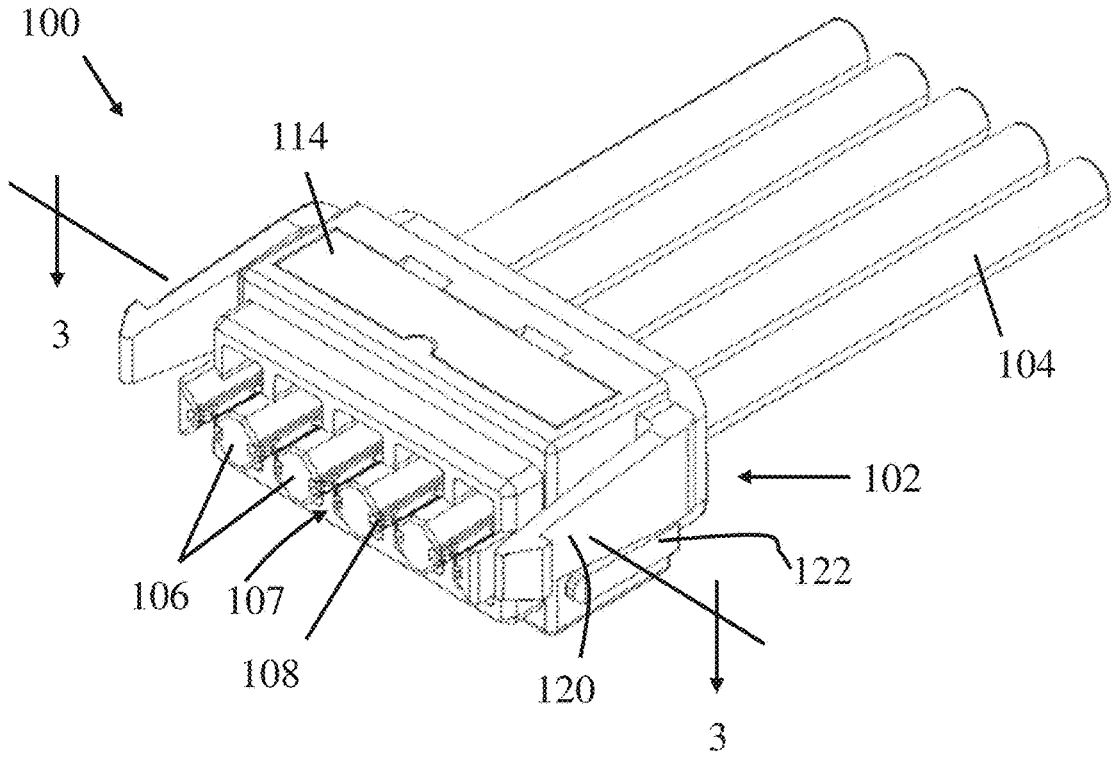
FIG. 1A is a perspective view of an exemplary cable connector.

The inventors have recognized and appreciated designs that yield safe, reliable and compact connectors. Reliable operation of the electrical connector may be enhanced by terminals that provide multiple points of contact when mated. Such electrical connectors may be mechanically robust, as the mated terminals are resistant to intermittent disconnection from vibration and/or shock. Further, the contact force of the terminals may be tuned to provide sufficient mating force to make a low resistance connection despite corrosion or other contaminants on the contact surfaces, without providing an undesirably high insertion force. In some embodiments, the mated terminals may have similar mating portions, oriented at 90 degrees with respect to each other, enabling both mating terminals to be blocked from inadvertent human contact by insulative projections of connector housings in which they are embedded, enhancing the safety of the connector.

The terminals may be simply formed at low cost by stamping opposing beams in a sheet of metal. Such a configuration may provide a high mating force, which retains the electrical connection between the terminals, enhancing the reliability of the connector. Despite the inherent stiffness of beams stamped from a sheet, contact force may be controlled such that the insertion force is in a suitable range. The contact force may be tuned by openings in the sheet near the base of the beams. A desired contact force may be provided even for relatively short beams, such that compact connector designs are enabled.

Further, the terminals may be stamped such that edges of the sheet of metal form surface mount contact tails. Those terminals may be shaped such that, when inserted in a connector housing, the tails extend through a mounting surface of the housing for surface mounting to a printed circuit board under the connector. Such a terminal configuration may further enhance connector safety, despite the use of terminals that are formed at low cost. The terminals may also provide a low bulk resistance and a low contact resistance.

Safety of the connector may be enhanced by embedding the beams of the terminals in projections at the mating face of the connector housing. The projections of the mating connectors may have a complementary configuration such that projections of one connector fit between the projections of the other connector. Separation between adjacent projections of each connector may be large enough that a terminal from a mating connector fits between the projections but small enough that a user's finger cannot contact the terminals between the projections. In this way, the mating portions of each connector are blocked from inadvertent contact by the projections in which they are embedded. As a result, the connector is suitable for use in making power connections and may be used, for example, to connect a battery subassembly to a printed circuit board powered from the battery.

The foregoing features may be used alone or in any combination of one or more such features.

Figure 1B:
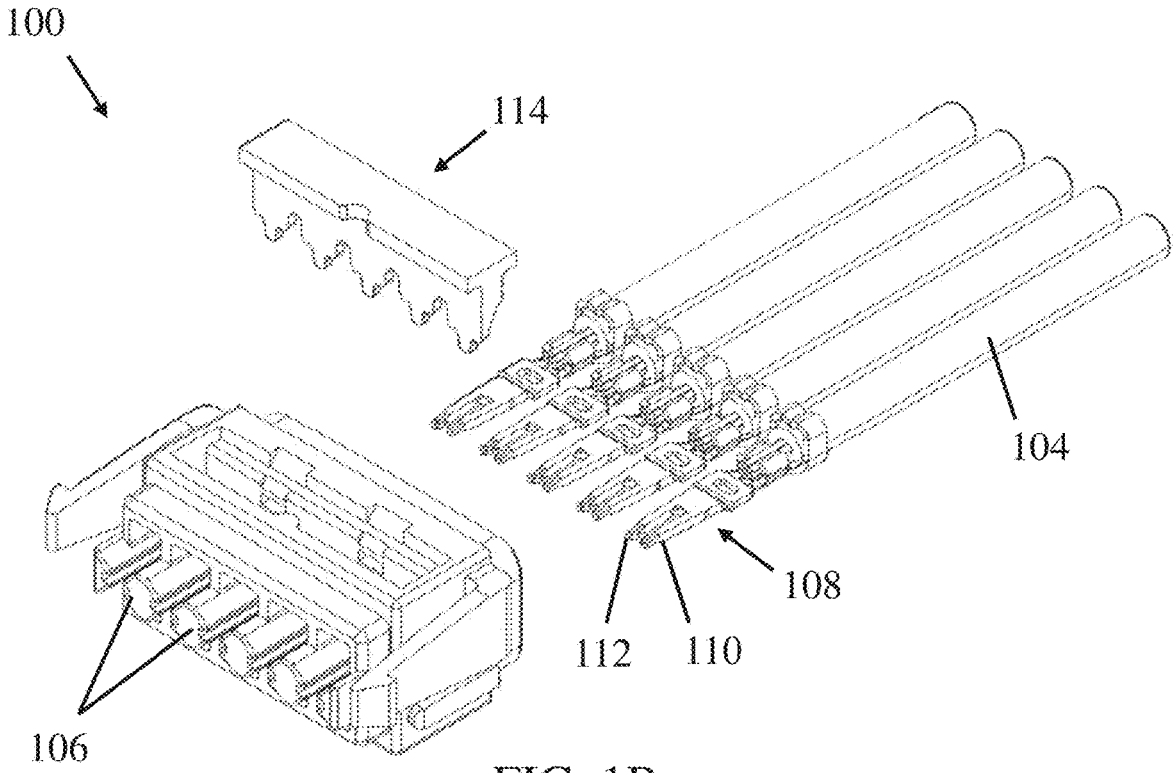
FIG. 1B is an exploded view of the cable connector of FIG. 1A.

FIG. 1A is a perspective view of an exemplary cable connector, and FIG. 1B is an exploded view of the same cable connector. In this embodiment, the cable connector 100 includes an insulative housing 102 that surrounds the ends of one or more cables 104. A plurality of terminals 108 are disposed within the housing 102 and connected to the ends the cables 104, such as by crimping a portion of the terminal around a conductor of the cable as shown in FIG. 1B. Each terminal includes a mating contact portion comprising a first beam 110 and an opposing second beam 112.

In this embodiment, the insulative housing 102 includes a plurality of projections 106 separated so as to provide spaces 107 adjacent the projections. The projections are configured such that a terminal 108 is aligned with a space 107 between adjacent projections 106. For a given terminal, the first beam 110 of the terminal is held at least partially within one projection, while the second beam 112 is held at least partially within an adjacent projection.

In this embodiment, the plurality of projections 106 extend beyond the distal ends of the plurality of terminals 108. The projections are longer than the mating portions of the terminals. Consequently, the projections block the terminals from inadvertent human contact, enhancing the safety of the connector. Nonetheless, in this embodiment, the projections 106 are separated by a gap. The gap is sized to receive a terminal of a mating connector, as described below. However, the gap is small enough to prevent a user from inadvertently touching the terminal, which may be 4 mm or less, in some embodiments, similarly enhancing the safety of the connector.

In the illustrated embodiment, a single projection 106 may hold two beams, one each from different terminals 108. For example, a single projection may hold the first beam 110 of one terminal, and the second beam 112 of an adjacent terminal. The beams of adjacent terminals my nonetheless be electrically insulated within the projection. Some projections, such as those at the ends of a row of projections, may hold only one beam. In other embodiments, each projection may hold only one beam. In some embodiments, some projections may hold more than two beams. It should be understood that this disclosure is not limited in regard to the number of beams held by a projection.

The connector may include a separate member or other structure to hold the terminals in the housing. In the embodiment illustrated in FIGS. 1A and 1B, a terminal locking member 114 may be inserted into the insulative housing. The terminal locking member is configured to be inserted into a recess in the insulative housing 102. Upon insertion into the insulative housing, portions of the terminal locking member enter holes in the terminals 108, holding the terminals in place relative to the housing of cable connector 100. The terminal locking member 114 is explained in greater detail below.

Connector 100 may also include features that facilitate mating with another connector and holding the mated connectors together. In the embodiment of FIGS. 1A and 1B, the cable connector 100 also includes a latching arm 120. Latching arm 120 is configured to fit into and engage a surface within a latching receptacle of a mating connector, holding the two connectors securely when mated. The cable connector 100 additionally includes an alignment rib 122 configured to aid in alignment as the cable connector is connected to a mating connector, as further described below.

Figure 2A:
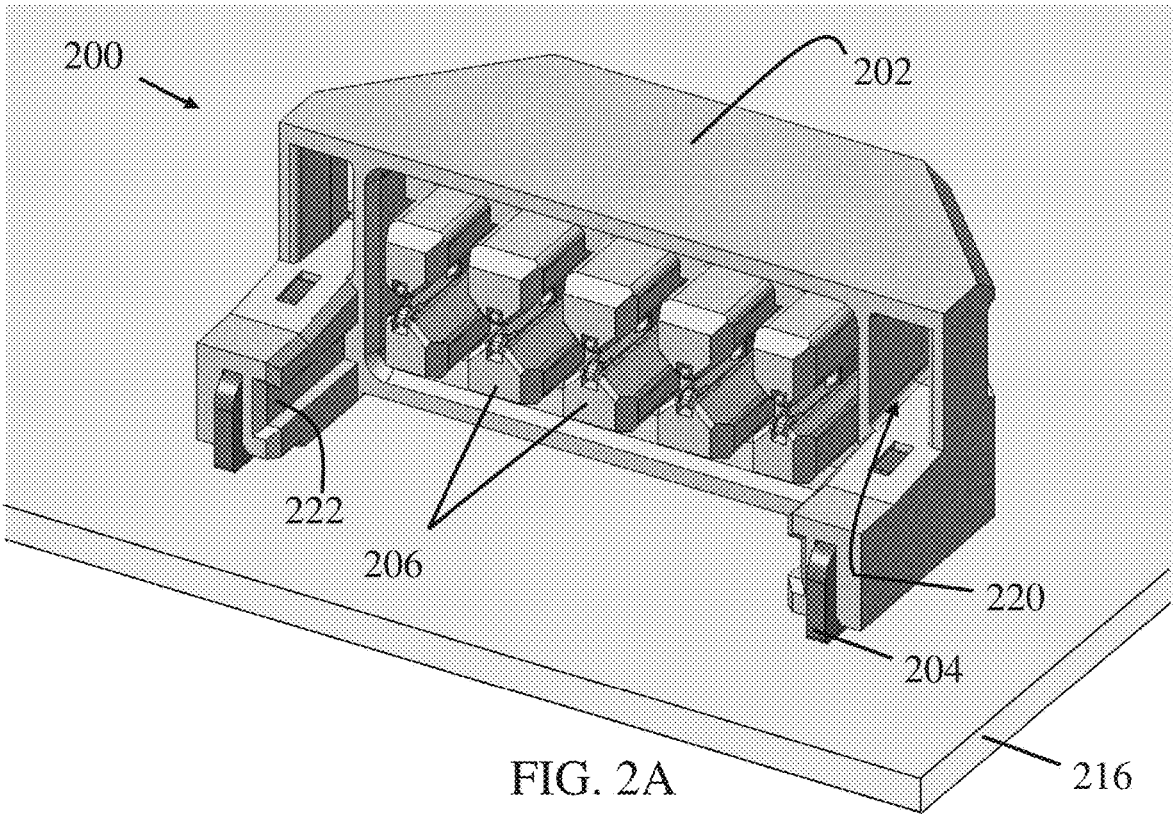
FIG. 2A is a perspective view of an exemplary board connector configured to mate with the cable connector of FIG. 1A.
Figure 2B:
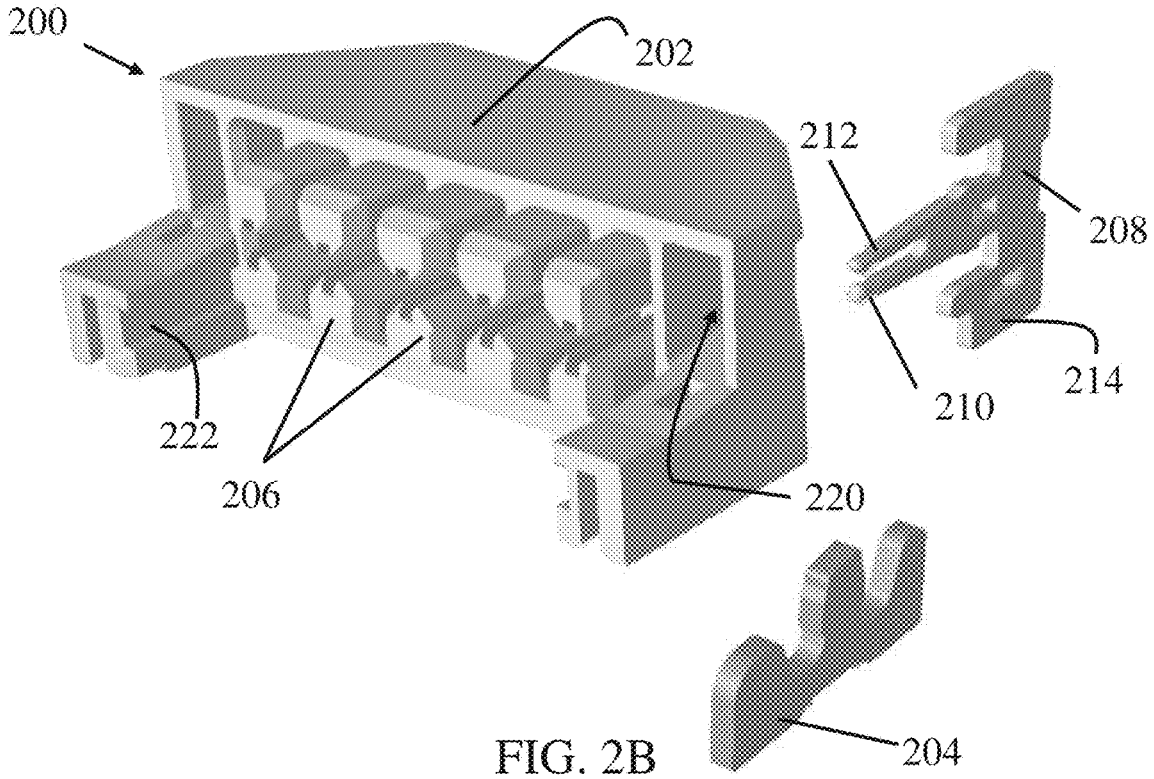
FIG. 2B is an exploded view of the board connector of FIG. 2A.

FIG. 2A is a perspective view of an exemplary connector configured to mate with the cable connector of FIG. 1A, while FIG. 2B is an exploded view of the same connector. Here, the connector includes an insulative housing 202 shaped to mate with connector 100. In this embodiment, the mating connector is a board connector 200, which is configured to be mounted to a printed circuit board. Accordingly, the connector includes one or more hold downs 204 to connect the insulative housing 202 to a printed circuit board 216. In this example, the hold downs 204 are configured for surface mount soldering to a printed circuit board. However, press fit hold downs or other attachment mechanisms may alternatively or additionally be used in some embodiments.

The board connector also includes a plurality of terminals 208. Each of a plurality of terminals 208 includes a mating contact portion comprising a first beam 210 and an opposing second beam 212, as well as a contact tail 214. Each terminal is held within the insulative housing 202. In this example, the contact tails 214 are configured for surface mount soldering to a printed circuit board. However, press fit contact tails may alternatively or additionally be used for board mount connectors of other configurations, and tails configured to attach to cables may be used for cable connectors.

In this embodiment, the insulative housing 202 includes a mating face. The mating face includes a plurality of projections 206 arranged in pairs. Each pair of the projections is associated with one of the plurality of terminals 208. The first beam 210 of the terminal is held at least partially within one projection of the pair, while the second beam 212 is held at least partially within the other projection of the pair.

In this embodiment, the projections 206 of the board connector 200 are sized and positioned to fit within the spaces 107 adjacent the projections 106 of the cable connector 100 when connector 100 and connector 200 are mated. The gaps between the projections 106 of the cable connector 100 are sized to receive terminals 208 of the board connector 200. Similarly, the gaps between the projections 206 of the board connector 200 are sized to receive terminals 108 of the cable connector 100. As will be made clear below, the terminals 208 of the board connector 200 are oriented so as to be perpendicular to the terminals 108 of the cable connector 100. This relative configuration allows the terminals to interface in the manner described above.

In the embodiment shown in FIGS. 2A and 2B, the plurality of projections 206 extend beyond the distal ends of the plurality of terminals 208. In this example, the projections are longer than the mating portions of the terminals. Consequently, the projections block the terminals from inadvertent human contact, enhancing the safety of the connector.

In this embodiment, the board connector 200 also includes a latching receptacle 220. The latching receptacle 220 of the board connector 200 is configured to receive the latching arm 120 of the cable connector 100. A surface within latching receptacle 220 may catch the hooked end of latching arm 120, holding the two connectors securely together when mated. The board connector 200 additionally includes an alignment groove 222 configured to receive the alignment rib 122 of the cable connector 100, aiding in alignment as the cable connector 100 is connected to the board connector 200. In addition to the alignment groove and the alignment rib, the shape of the projections on both connectors aids in alignment. The projections may serve as guide features during blind mating.

Figure 3:
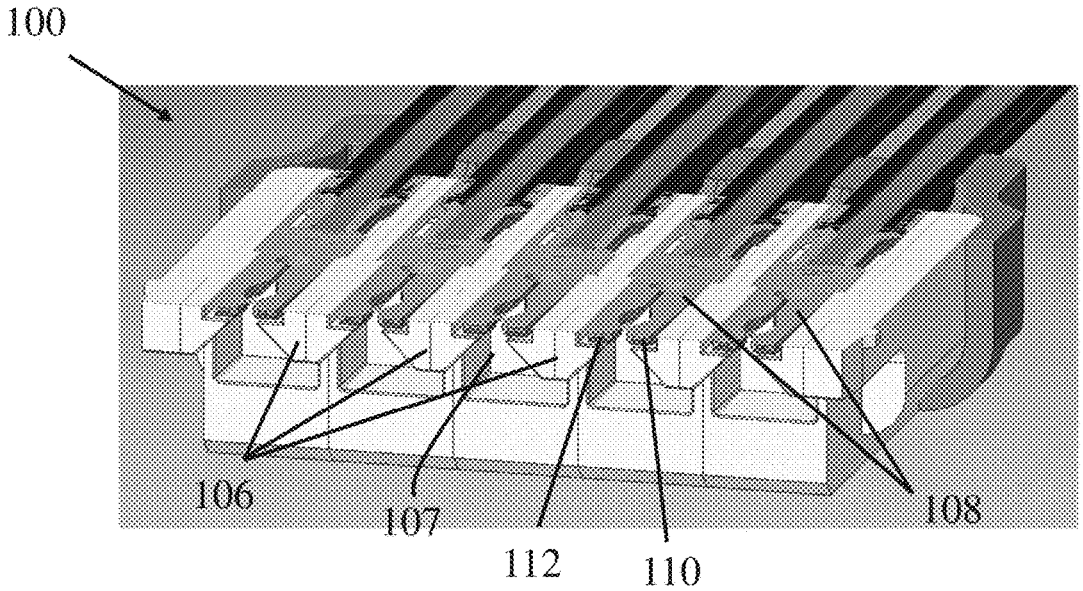
FIG. 3 is a cross section of the cable connector of FIG. 1A, taken along the line 3-3.

FIG. 3 is a cross section of the cable connector of FIG. 1A, taken along the line 3-3. As described above, each terminal 108 of the cable connector 100 includes a first beam 110 and a second beam 112. The first beam 110 is held at least partially within one projection of the plurality of projections 106, while the second beam 112 is held at least partially within an adjacent projection. In this embodiment, the projections 106 of the cable connector 100 are arranged linearly in a single row. Consequently, the terminals 108 are arranged to be coplanar. As a frame of reference, the plane that contains the terminals may be described as horizontal. As can be seen in FIG. 3, the terminals are held within the connector housing with their broadsides in the horizontal plane.

Figure 4:
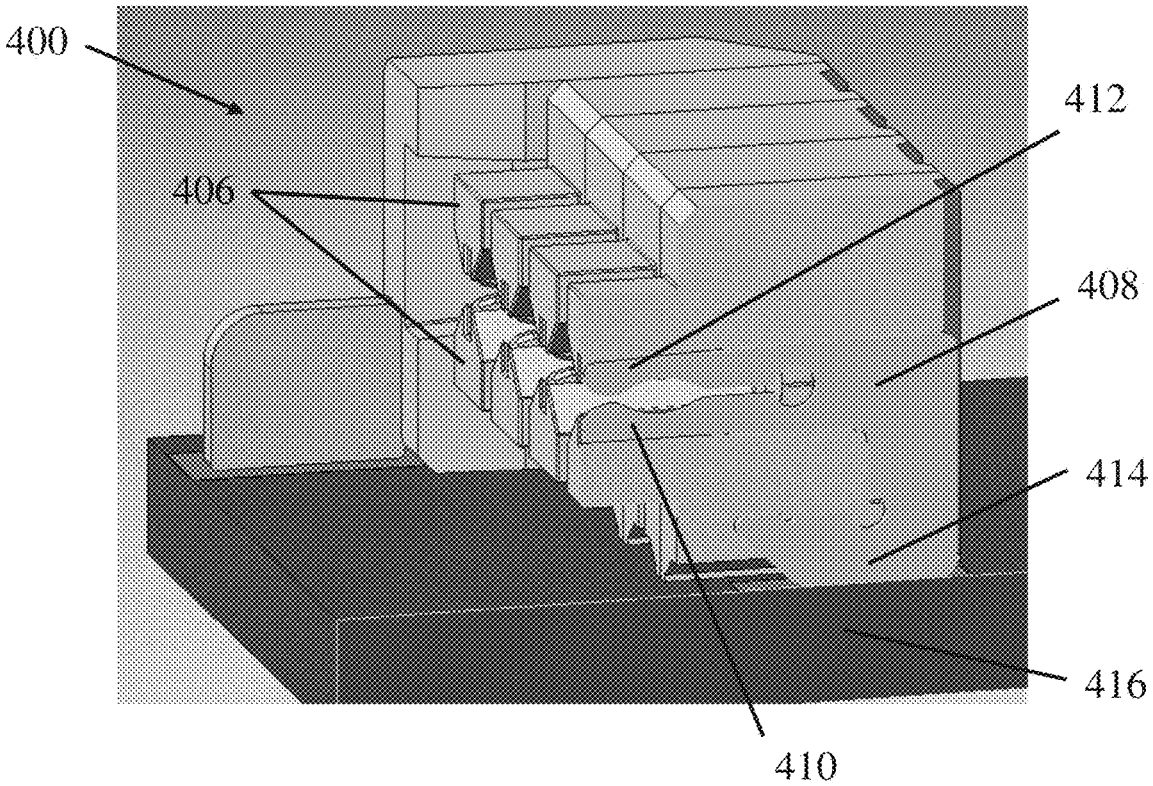
FIG. 4 is a cross section of a board connector having a mating interface configured as in FIG. 2A.

FIG. 4 is a cross section of a board connector having a mating interface configured as in FIG. 2A. Each terminal 408 of a board connector 400 includes a first beam 410 and a second beam 412. Additionally, projections 406 are arranged in pairs, such that there are two rows of projections, with one projection of each pair in the top row of projections, and the second projection of each pair in the bottom row of projections. When connector 400 is mated with connector 100, the rows of projections 406 will be parallel to the row of projections 106. Accordingly, the rows of projections of connector 400 may similarly be regarded as being in the horizontal plane. The horizontal plane, in this example, is also parallel to a surface of printed circuit board 416 to which board connector 400 is mounted.

The first beam 410 is held at least partially within the bottom projection of the pair of projections, while the second beam 412 is held at least partially within the top projection of the pair of projections. As such, the terminals 408 are configured to be held within the housing with their broadsides in planes that are transverse to the horizontal plane containing the terminals of connector 100. In this example, the terminals of connector 400 are mounted with their broadsides at a 90 degree angle with respect to the terminals in connector 100, and may be said to be within parallel vertical planes.

Figure 5A:
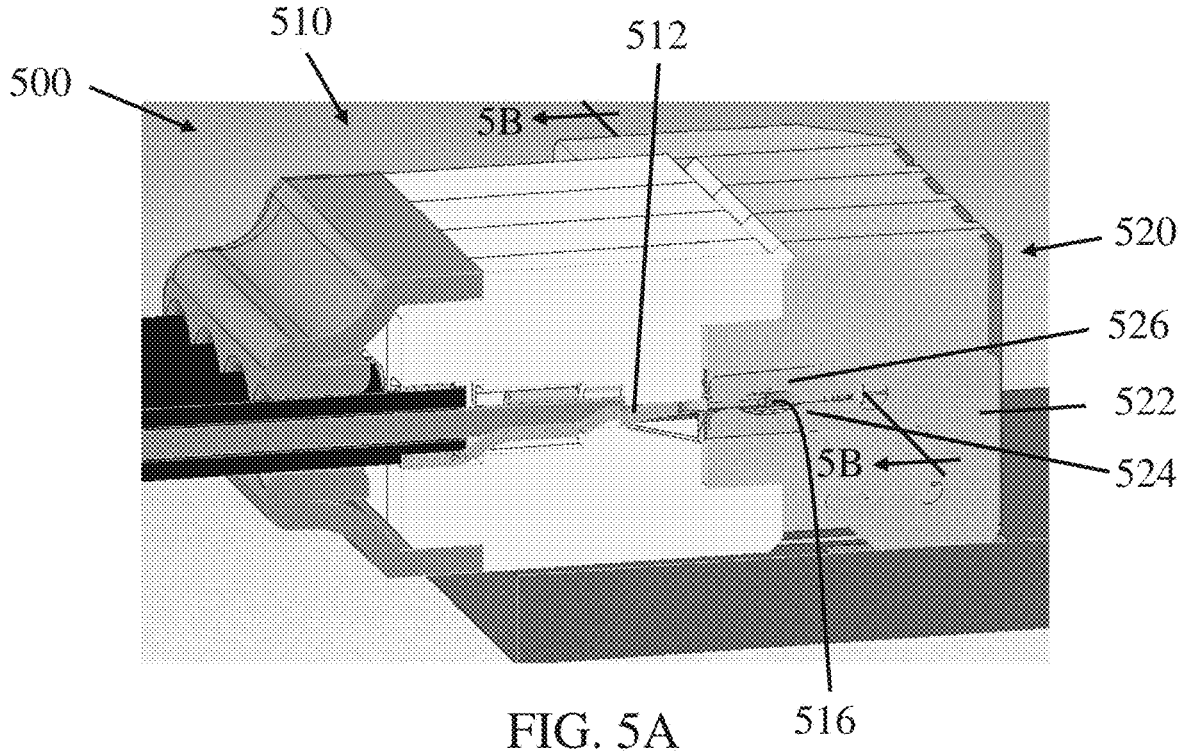
FIG. 5A is a cross section through a mated cable connector having a mating interface as in FIG. 1A and a board connector having a mating interface as in FIG. 2A.

FIG. 5A is a cross section through a connector having a mating interface as in FIG. 1A and a connector having a mating interface as in FIG. 2A when mated. In this example, the mated connectors 500 include a cable connector 510 and a board connector 520. The cable connector 510 includes a plurality of projections 518 and a plurality of terminals 512. Each terminal 512 includes a first beam (not shown) and a second beam 516. The board connector 520 includes a plurality of projections 528 and a plurality of terminals 522. Each terminal 522 includes a first beam 524 and a second beam 526.

As the cable connector 510 is mated with the board connector 520, the projections 518 of the cable connector 510 fit within spaces adjacent the projections 528 of the board connector 520. Similarly, the projections 528 of the board connector 520 fit within spaces adjacent the projections 518 of the cable connector 510. As a result of the arrangement of the terminals 512 of the cable connector 510 and the terminals 522 of the board connector 520, as described above, as the cable connector and the board connector are mated, the terminals 512 contact the terminals 522, as described below.

Figure 5B:
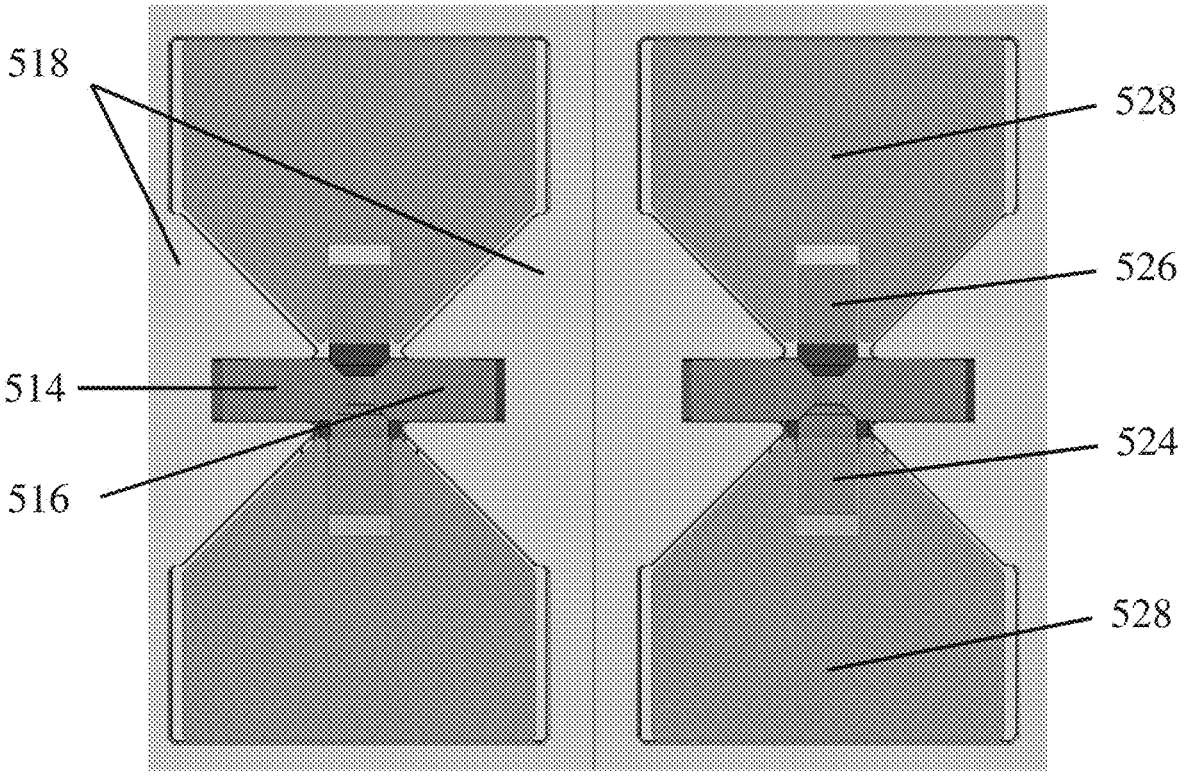
FIG. 5B is a partial cross section showing two mated terminals of the connectors of FIG. 5A, taken along the line 5B-5B.

FIG. 5B is a partial cross section showing two mated terminals of the connectors of FIG. 5A, taken along the line 5B-5B. When the cable connector 510 is mated to the board connector 520, the first beam 514 and the second beam 516 of the cable connector terminal 512 press on the board connector terminal 522 from opposing sides. Similarly, the first beam 524 and the second beam 526 of the board connector terminal 522 press on the cable connector terminal 512 from opposing sides. In this way, four points of contact are provided in each pair of mated terminals, resulting in a connection that is mechanically robust and resistant to intermittent disconnection from vibration and/or shock.

As shown in FIG. 5B, the first beam 514 and the second beam 516 of each cable connector terminal 512 are separated in a horizontal direction, while the first beam 524 and the second beam 526 of each board connector terminal 522 are separated in a vertical direction. This perpendicular arrangement of terminals enables the connection interface described above. However, although the terminals as shown in the figures may be described as oriented in horizontal and vertical directions, the absolute orientation of any terminal is less important than the relative, perpendicular orientation of the mated terminals.

Figure 6A:
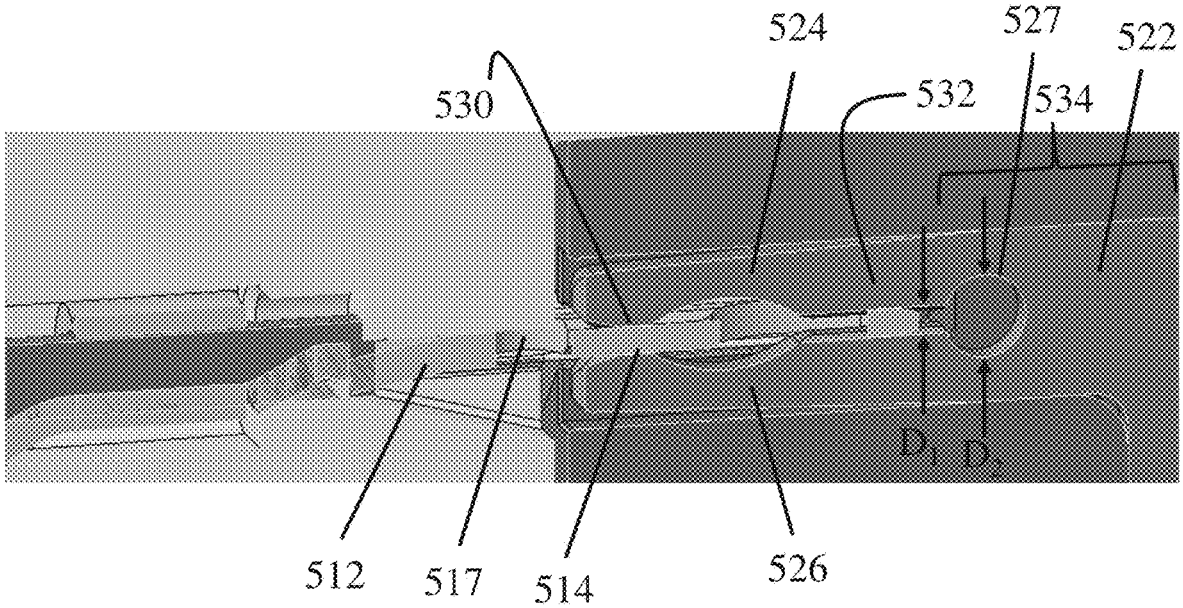
FIG. 6A is an enlarged cross sectional view through mated terminals of connectors as shown in FIG. 5A.

FIG. 6A is an enlarged cross sectional view through mated terminals of connectors as shown in FIG. 5A. In the figure, a cable connector terminal 512 is mated to a board connector terminal 522. The cable connector terminal 512 includes a first beam 514, a second beam (not shown), and an opening 517 that passes through the terminal 512. Similarly, the board connector terminal 522 includes a first beam 524, a second beam 526, and an opening 527 that passes through the terminal 522.

As FIG. 6A shows the board connector terminal 522 more clearly, the board connector terminal is described in detail. However, it should be understood that an analogous description may be applied to the cable connector terminal 512, because, in the illustrated embodiment, the mating contact portions of both terminals have the same shape, though oriented at a 90 degree angle with respect to each other. Board connector terminal 522 may be stamped from a sheet of metal to have a first beam 524 and a second beam 526. Each of the beams may have a concave surface 530 near a distal tip of the beam and a base portion 532. The concave surface 530 may press against a surface of the base portions 532 of the mating terminal 512. In some embodiments, concave surfaces 530 may be coined or otherwise smoothed or rounded and may be plated with gold or other conductive material resistant to oxidation to enhance electrical contact. As shown in FIG. 6A, the beams of one terminal may press against a mating terminal in the vicinity of a slot between the beams of the mating terminal. Accordingly, contact may be made in a region generally including surfaces of the beams adjacent the slot, walls of the terminal bounding the slot, and/or corners between the wall and the surface. Such contact may be generally described as on the surface.

The board connector terminal 522 comprises a body 534 with a first beam 524 and a second beam 526 extending from the body 534. Where the first and second beams extend from the body, the two beams are separated by a distance $D_1$. As described above, the board connector terminal 522 comprises an opening 527 that passes through the terminal. The opening is disposed at a location within the body 534 of the board connector terminal 522 between locations where the first beam 524 and the second beam 526 extend from the body. At the opening 527, the two beams are separate by a distance $D_2$, wherein $D_2$ is at least twice $D_1$.

Figure 6B:
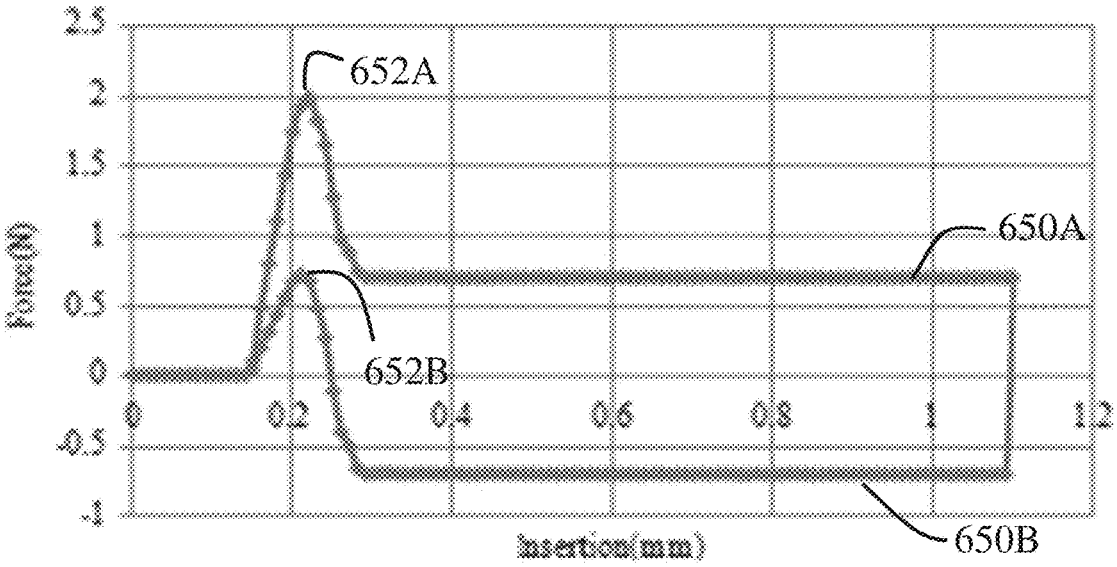
FIG. 6B is a graph of contact force as a function of insertion distance.

FIG. 6B is a graph of contact force as a function of insertion distance. The graph includes two contact force curves. The mating force curve 650A depicts the contact force as a function of insertion distance during mating, while the un-mating force curve 650B depicts the contact force as a function of insertion distance during un-mating. The peak of the mating force curve 650A is the mating force 652A, while the peak of the un-mating force curve 650B is the un-mating force 652B. As can be seen in the graph, the mated terminals may generate a mating force between 1.75 N and 2.5 N. In FIG. 6B, the mating force 652A is about 2.0 N. Similarly, the mated terminals may generate an un-mating force between 0.6 N and 0.8 N. In FIG. 6B, the un-mating force is about 0.7 N.

The mating and un-mating forces of a terminal may be controlled by altering the opening within a terminal. FIG. 6A shows a terminal 522 with an opening 527 that is a circle. However, the opening may also be a hexagon, a rectangle, a hexalobular star, an ellipse, a triangle, or any other suitable shape. Similarly, FIG. 6A shows a terminal with an opening of a particular size. However, the size of the opening may be either increased or decreased to tune the contact force profile.

Other factors, such as the material used to form the terminals, thickness of the material from which the terminals are stamped as well as the length of the opposing beams may, in addition to size of the openings of the terminals, impact the mating and un-mating force for the terminals. However, other connector requirements may constrain values of other parameters of the terminal design. The beams may desirably have a length in the range of 4 mm to 10 mm to provide a suitable amount of wipe during mating, without providing an unacceptably large bulk resistance. As another example, the terminals may be stamped from a sheet of copper alloy or similar material to provide suitable bulk resistance. Such materials may have a thickness in the range of 0.5 mm to 1.5 mm to provide suitable bulk resistance for the terminals. As a specific example, the bulk resistance of each terminal may be between 1 mOhm and 4 mOhm. Nonetheless, use of openings allows a suitable range of forces for materials that are suitable and readily available for use in connectors. In accordance with some embodiments, the mating force may be between 1.5 N and 3.0 N, and the un-mating force between 0.4 N and 1.0 N, in some embodiments.

Figure 7A:
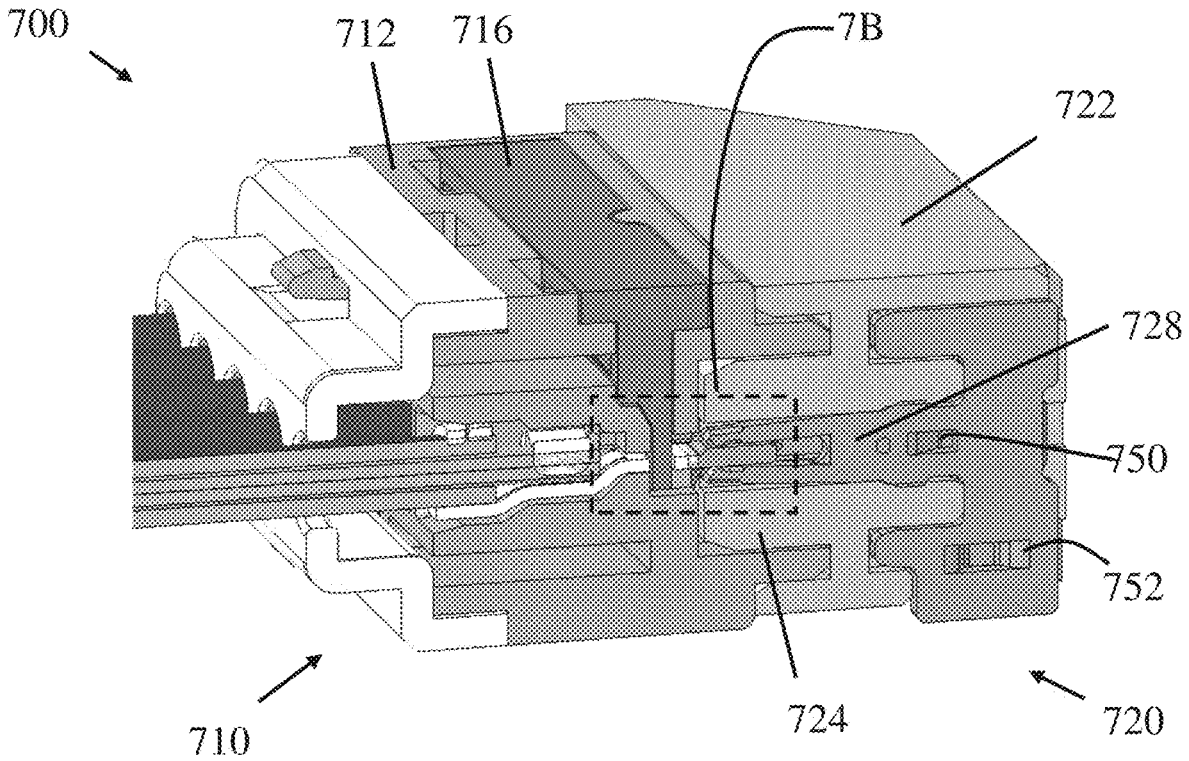
FIG. 7A is a side view of a mated cable connector and board connector, with the side partially cut away, to reveal a terminal locking member.
Figure 7B:
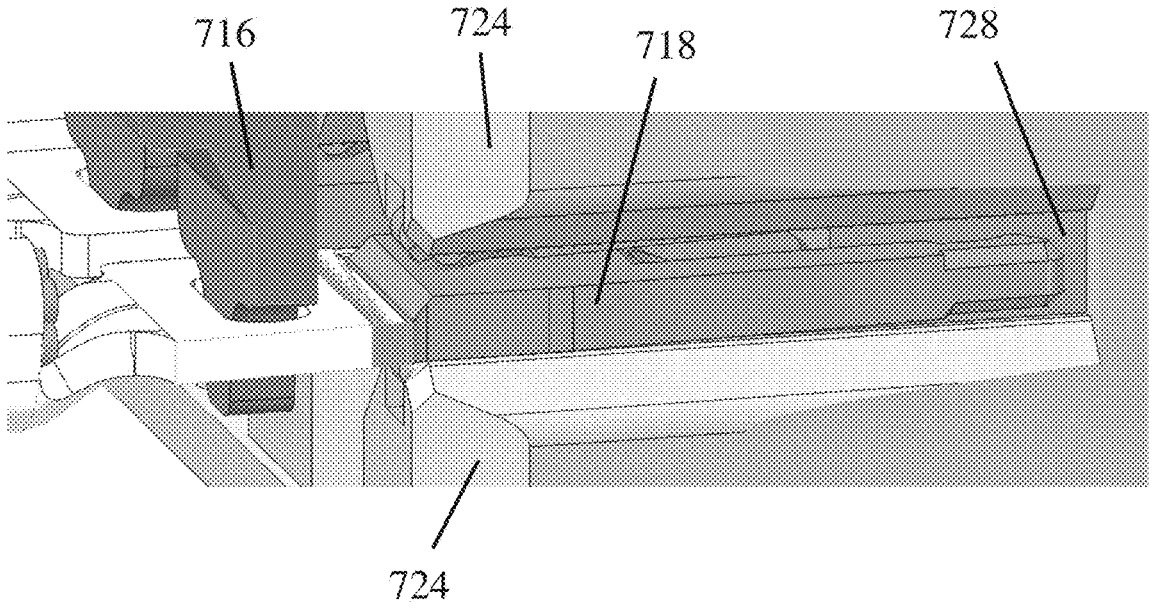
FIG. 7B is an enlarged view of the region 7B in FIG. 7A.

FIG. 7A is a side view of a mated cable connector and board connector, with the side partially cut away, to reveal a terminal locking member, while FIG. 7B is an enlarged view of the region 7B in FIG. 7A. The mated connectors 700 include a cable connector 710 and a board connector 720. The cable connector 710 includes an insulative housing 712, and a terminal locking member 716, configured to be inserted into a recess of the insulative housing 712. Use of a terminal locking member enables the terminals in cable connector 710 to be attached to a conductor of a cable and then easily inserted into passages in housing 712. Terminal locking member 716 may thereafter be inserted to both ensure that the terminals are in the proper location and locked in place.

As the terminal locking member 716 is inserted into the insulative housing 712 of the cable connector 710, portions of the terminal locking member 716 are inserted through holes in the cable connector terminals 718. If the terminals are not appropriately located within the housing, terminal locking member will not pass through the holes, providing an indication that the terminals are not properly inserted. With the terminal locking member 716 in place, the cable connector terminals 718 are constrained so as to be unable to move with respect to the cable connector 710. It should be appreciated that although the above discussion concerns a terminal locking member associated with a cable connector, an analogous terminal locking member may be associated with the board connector.

In the embodiment illustrated, however, other mechanisms are used to hold the terminals in board connector 720. The board connector 720 includes an insulative housing 722 comprising a plurality of projections 724. As described above, a plurality of board connector terminals 728 are held within pairs of projections of the board connector 720. The terminals may be held in place, for example, with barbs 750 or punch outs 752 that press into openings in the housing.

Terminals for connectors with a mating interface as described herein may have contact tails configured for use in any of multiple applications, including termination to a board or termination to a cable or termination to another substrate. When configured for mounting to a board, the tails of each terminal may be shaped as press fits or shaped for solder mounting. In the illustrated embodiment, board mount terminals are configured for solder mount, and are configured to use a small amount of space on a printed circuit board as well as to reduce accidental contact with the terminals, enhancing safety of an electronic system using such a terminal.

Figure 8A:
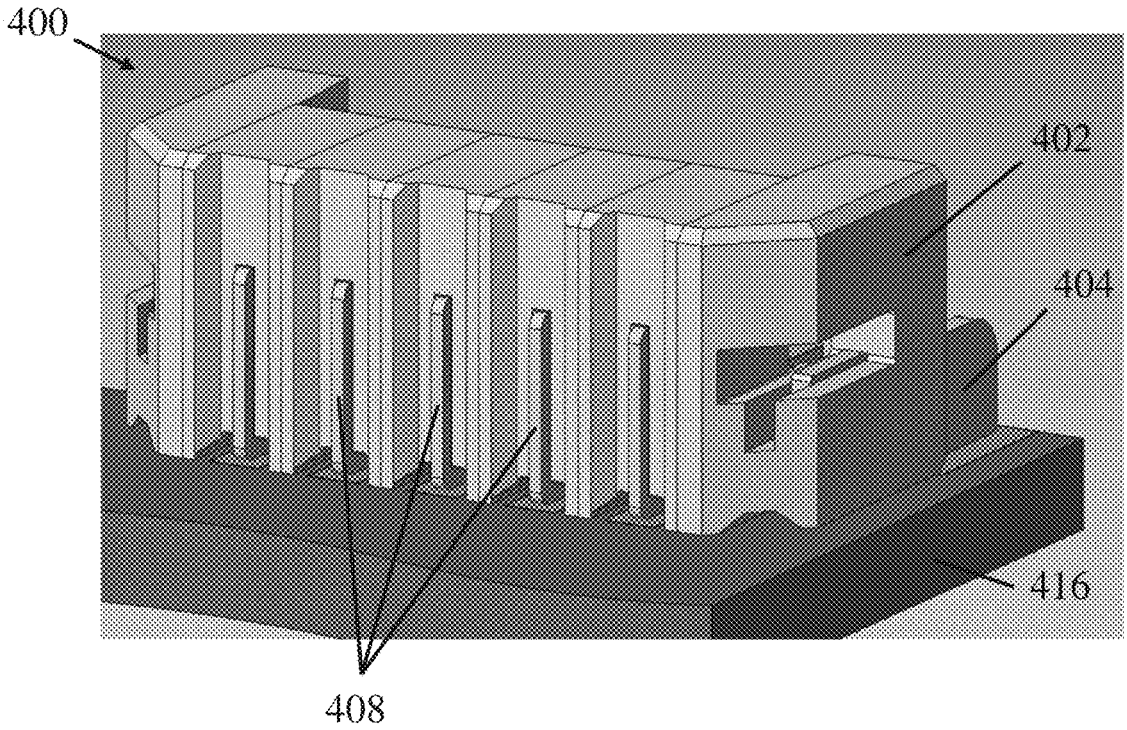
FIG. 8A is a rear perspective view of the board connector of FIG. 4.
Figure 8B:
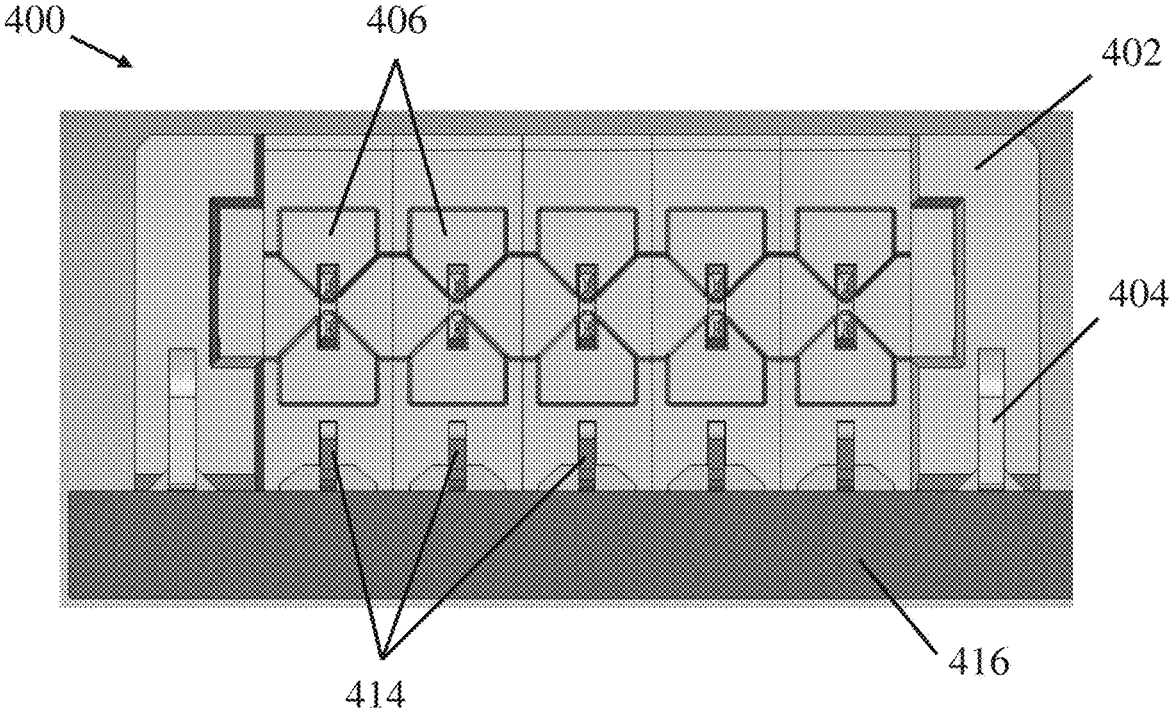
FIG. 8B is a front view of the board connector of FIG. 4.

FIG. 8A is a rear view of the board connector of FIG. 4, while FIG. 8B is a front view of the same board connector. These views show the terminals 408 of the board connector 406 electrically connected to a printed circuit board 416. Specifically, the contact tails 414 of the terminals 408 are connected to the printed circuit board 416 under the body of the board connector 400. The insulative housing 402 of the board connector 400 has a mounting face positioned such that the mounting face faces the printed circuit board 416 when the board connector 400 is mounted to the printed circuit board 416. The contact tails 414 extend through the mounting face and are configured to attach to the printed circuit board 416 at locations between the mounting face and the printed circuit board 416. In this example, that mounting location is under the board connector 400. Such a terminal configuration may enhance connector safety by reducing the degree to which portions of the terminals 408 are exposed.

Figure 9:
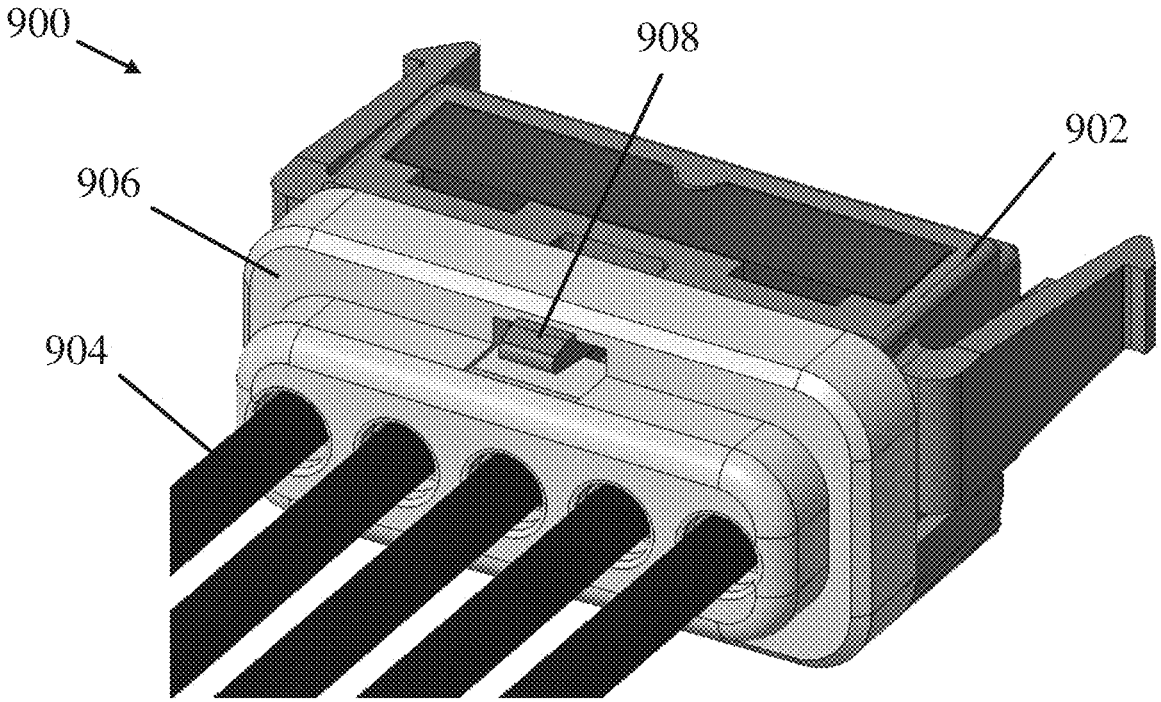
FIG. 9 is a rear perspective view of a cable connector with a boot installed.

FIG. 9 is a rear view of a cable connector with a boot installed. The cable connector 900 includes an insulative housing 902 that receives one or more cables 904. A cable exit boot 906 is disposed at the interface between the insulative housing 902 and the cables 904. The boot 906 is secured to the insulative housing 902 with a latch 908. The boot 906 may provide strain relief and enhance the overall robustness of the cable connector 900.

Figure 10:
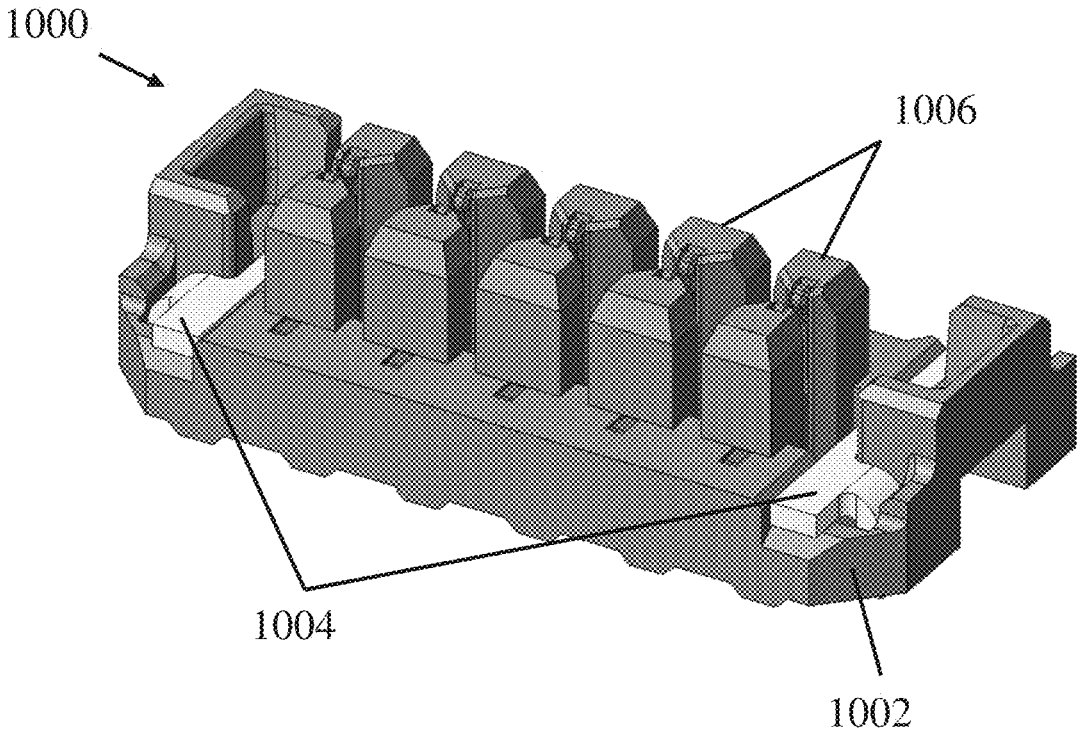
FIG. 10 is a perspective view of an alternative embodiment of a board connector, configured for vertical mating with a mating connector.

FIG. 10 is a perspective view of an alternative embodiment of a board connector, configured for vertical mating with a mating connector. The board connector 1000 includes an insulative housing 1002, hold downs 1004, and a plurality of projections 1006. In this embodiment, the projections 1006 extend vertically. That is, when the board connector 1000 is mounted to a printed circuit board, the projections 1006 extend in a direction perpendicular to the plane of the printed circuit board. Terminals within connector 1000 may have mating contact portions as described above in connection with FIGS. 2A and 2B. As with the embodiment of FIGS. 2A and 2B, the terminals of connector 1000 may be mounted in the connector housing with opposing beams at least partially embedded in adjacent projections. Similarly, those terminals may have contact tails configured for mounting to a printed circuit board. Here, those terminals may be configured for surface mount soldering to the printed circuit board. In contrast to the embodiment of FIGS. 2A and 2B, however, the tails of the terminals of connector 1000 may be perpendicular to the beams of the mating contact portions rather than parallel to the beams.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

For example, interconnections between cable connectors and board connectors were illustrated. Connectors as described herein may alternatively be used to connect two boards, two cables, or any other substrates to which terminals with mating contact portions configured as described herein may be terminated.

Further, embodiments of board connectors were disclosed in which the mating interface was oriented to receive a mating connector in a direction parallel to the board or perpendicular to it. It should be appreciated that cable connectors can similarly be configured with a mating direction parallel to or perpendicular to the direction in which cables exit the connector housing. It should be further appreciated that parallel and perpendicular are two examples of relative angles between a substrate to which the terminals of a connector are terminated and the mating direction of that connector, and techniques as described herein may be used in connectors with any such angle.

As another example of a possible variation, connectors were shown with latching arms on a cable connector and a complementary latching receptacle on a mating board connector. An embodiment of a board connector with latching arms, configured to mate with a cable connector with latching receptacles rather than latching arms is also contemplated. Accordingly, it should be appreciated that, in various embodiments, mating connectors may be configured with complementary latching and/or locking components other than as illustrated herein.

As yet a further variation, board connectors with surface mount solder hold-downs were illustrated. Press fit hold downs may also be used. Alternatively or additionally, a board connector might be secured to a board with screws or fasteners of other types.

Accordingly, the foregoing description and drawings are by way of example only.

What is claimed is:

1. An electrical connector, comprising:

an insulative housing comprising a mating face comprising a plurality of projections arranged in pairs;

a plurality of terminals comprising mating contact portions, each mating contact portion comprising a first beam and an opposing second beam, wherein:

each of the plurality of terminals is held within the insulative housing with the first beam of the terminal at least partially within a first projection of a pair of projections of the plurality of projections and the second beam of the terminal at least partially within a second projection of the pair of projections, the first projection of the pair and the second projection of the pair are separated by a gap sized to receive a mating terminal with a mating contact portion perpendicular to mating contact portions of the plurality of terminals, and for each of the plurality of terminals:

the terminal comprises a body with the first beam and the second beam extending from the body;

the first beam and the second beam are separated in a first direction by a first distance where the first beam and the second beam extend from the body;

the body of each of the plurality of terminals comprises an opening therethrough between locations where the first beam and the second beam extend from the body;

the opening extends in the first direction a second distance; and the second distance is at least twice the first distance.

2. The electrical connector of claim 1, in combination with a printed circuit board, wherein one or more terminals of the plurality of terminals is electrically connected to the printed circuit board.

3. The electrical connector of claim 1, wherein:

the housing further comprises a mounting face positioned such that the mounting face is facing a printed circuit board when the electrical connector is mounted to the printed circuit board;

the plurality of terminals comprise contact tails extending through the mounting face; and the contact tails are configured for attachment to the printed circuit board at locations between the mounting face and the printed circuit board.

4. The electrical connector of claim 1, wherein the plurality of projections extend beyond the plurality of terminals.

5. The electrical connector of claim 4, wherein:

the plurality of projections are disposed in a row extending in a row direction;

mating contact portions of the plurality of terminals comprise broadsides; and the broadsides of the plurality of terminals are disposed in a plane parallel to the row direction.

6. The electrical connector of claim 4, wherein:

the plurality of projections are disposed in pairs in a row extending in a row direction, with projections of the pairs separated in a direction perpendicular to the row direction;

mating contact portions of the plurality of terminals comprise broadsides; and the broadsides of the plurality of terminals are disposed in a plurality of planes perpendicular to the row direction.

7. A first electrical connector in combination with a second electrical connector, configured to mate to the first electrical connector, wherein:

the first electrical connector comprises:

a first insulative housing comprising a first plurality of projections separated so as to provide spaces adjacent the projections of the first plurality of projections;

a first plurality of terminals comprising a plurality of mating contact portions, each mating contact portion of the plurality of mating contact portions comprising a first beam and an opposing second beam, wherein each of the first plurality of terminals is held within the first insulative housing with the first beam of the terminal at least partially within a first projection of the first plurality of projections and the second beam of the terminal at least partially within a second projection of the first plurality of projections;

the second electrical connector comprises:

a second insulative housing comprising a second plurality of projections sized to fit within the spaces adjacent the projections of the first plurality of projections;

a second plurality of terminals comprising a plurality of mating contact portions, each mating contact portion of the plurality of mating contact portions comprising a first portion held within a first projection of the second plurality of projections, a second portion held within a second projection of the second plurality of projections;

the first electrical connector and the second electrical connector are configured such that, upon mating, the first beam and the second beam of the first plurality of terminals press on respective terminals of the second plurality of terminals between the first portions and the second portions of the respective terminals.

8. The combination of claim 7, wherein:

for each of the first plurality of terminals, the first beam and the second beam are separated in a first direction;

for each of the second plurality of terminals, the first portion and the second portion are separated in a second direction, perpendicular to the first direction.

9. The combination of claim 7, wherein:

the mating contact portions of the second plurality of terminals each comprise a first beam and an opposing second beam.

10. The combination of claim 9, wherein the opposing beams of the second plurality of terminals each presses against a respective terminal of the first plurality of terminals.

11. The combination of claim 10, wherein:

each of the second plurality of terminals, in combination with the respective terminal of the first plurality of terminals, generates an un-mating force between 0.6 N and 0.8 N.

12. The combination of claim 10, wherein:

each of the second plurality of terminals, in combination with the respective terminal of the first plurality of terminals, generates a mating force between 1.75 N and 2.5 N.

13. The combination of claim 12, wherein:

each of the second plurality of terminals, in combination with the respective terminal of the first plurality of terminals, generates an un-mating force between 0.6 N and 0.8 N.

14. The combination of claim 13 wherein:

the bulk resistance of each of the second plurality of terminals mated with the respective terminal of the first plurality of terminals is less than 4 mOhm.

15. The combination of claim 14, wherein:

the bulk resistance is between 1 mOhm and 4 mOhm.

16. The combination of claim 13, wherein, for each of the first plurality of terminals:

the terminal comprises a body with the first beam and the second beam extending from the body;

the first beam and the second beam are separated in a first direction by a first distance where the first beam and the second beam extend from the body;

the body of each of the first plurality of terminals comprises an opening therethrough between locations where the first beam and the second beam extend from the body;

the opening extends in the first direction a second distance; and the second distance is at least twice the first distance.

17. The combination of claim 16, wherein the opening is one of a circle, a hexagon, a rectangle, a hexalobular star, an ellipse, and a triangle.

18. A method of mating a first connector with a second connector, the method comprising:

inserting first insulative projections of a mating face of the first connector in openings between second insulative projections in a mating face of the second connector and inserting the second insulative projection in openings between the first insulative projections; and in each of a plurality of spaces bounded by adjacent first insulative projections and adjacent second insulative projections, sliding at least two contact surfaces of a first terminal in the first connector across at least two surfaces of a respective second terminal in the second connector and sliding at least two contact surfaces of the second terminal in the second connector across at least two surfaces of the respective first terminal in the first connector, wherein there are four points of contact between the first terminal and the second terminal in a respective space of the plurality of spaces.

19. The method of claim 18, wherein:

the first projections of the first connector are inserted between second projections of the second connector in a first direction;

the method further comprises inserting latching arms of one of the first or second connectors into recesses in the other of the first or second connectors.

20. The method of claim 18, wherein:

the first terminal and the second terminal each comprises a body and a pair of beams extending from the body, and each point of contact of the four points of contact between the first terminal and the second terminal is formed between a surface on a beam of one of the first terminal and the second terminal and a surface on the body of the other of the first terminal and the second terminal.

21. The method of claim 18, wherein:

first and second points of contact of the four points of contact between the first terminal and the second terminal are on surfaces in a first plane, and third and fourth points of contact of the four points of contact between the first terminal and the second terminal are on surfaces in a second plane that is orthogonal to the first plane.

22. A method of mating a first connector with a second connector, the method comprising:

inserting first insulative projections of a mating face of the first connector in openings between second insulative projections in a mating face of the second connector and inserting the second insulative projection in openings between the first insulative projections; and in each of a plurality of spaces bounded by adjacent first insulative projections and adjacent second insulative projections, sliding at least two contact surfaces of a first terminal in the first connector across at least two surfaces of a respective second terminal in the second connector and sliding at least two contact surfaces of the second terminal in the second connector across at least two surfaces of the respective first terminal in the first connector, wherein:

the first terminal and the second terminal each comprises a body and a pair of beams extending from the body with an opening in the body adjacent a base of the beams of the pair; and the method further comprises:

deflecting the pair of opposing beams of the first terminal to generate a contact force with a magnitude based, at least in part, on a size of the opening in the body of the first terminal; and deflecting the pair of opposing beams of the second terminal to generate a contact force with a magnitude based, at least in part, on a size of the opening in the body of the second terminal.

* * * * *